US005649382A

United States Patent [19]

O'Keefe

[11] Patent Number: 5,649,382

[45] Date of Patent: Jul. 22, 1997

[54] PICTURE FRAME

[76] Inventor: Joseph S. O'Keefe, 7194 Caminito Zabala, San Diego, Calif. 92122

[21] Appl. No.: 321,442

[22] Filed: Oct. 11, 1994

[51] Int. Cl.[6] ..... G09F 01/12

[52] U.S. Cl. ..... 40/790; 40/785

[58] Field of Search ..... 40/152, 152.1, 40/159.1, 156, 668, 155; 411/451, 457, 470, 921

[56] References Cited

U.S. PATENT DOCUMENTS

| | | | |
|---|---|---|---|
| 1,253,847 | 1/1918 | Lynch | 40/152 |
| 1,438,575 | 12/1922 | Brown | 411/457 X |
| 1,895,818 | 1/1933 | Regan | 40/152 |
| 3,936,968 | 2/1976 | Gilbert | 40/155 |
| 4,356,648 | 11/1982 | Beaulieu | 40/152 X |
| 4,974,352 | 12/1990 | Chen | 40/152 |

FOREIGN PATENT DOCUMENTS

| | | | |
|---|---|---|---|
| 2683984 | 5/1993 | France | 40/152 |
| 8004562 | 3/1982 | Netherlands | 40/152 |

*Primary Examiner*—Joanne Silbermann
*Attorney, Agent, or Firm*—Thomas J. Tighe

[57] ABSTRACT

An easily assembled, light weight, wall mountable picture frame for displaying posters, pictures, documents or other generally planar objects. The picture frame has hard plastic connecting pieces that receive and enclose the ends of rigid foam side members and which can be assembled in various polygonal and multiple polygonal shapes. The frames can easily be constructed to the size needed without the use of tools, except perhaps a table knife or equivalent. The side members can be secured in the connecting pieces by barb clips which fit into sockets defined by the connecting pieces. The barb clips have a barbed spike that pierces and anchors in the foam, thereby locking the side members in place. The barb clips also hold the edge of the poster or other document in the frame. Additional stability and strength can be provided by pressing barb clips into the mid-spans of the rigid foam side members and threading a tension line through loops defined by the barb clips and tying the line in a taut closed loop.

17 Claims, 5 Drawing Sheets

PICTURE FRAME

BACKGROUND OF THE INVENTION

This invention relates in general to picture frames and more particularly to picture frames assembled using hard connector pieces and side members made of rigid foam.

As used herein the terms "foam" and "rigid foam" refers to rigidly set foam, whether molded, formed or extruded, such as two pound expanded polystyrene also known as rigid styrofoam, including non-foam materials that have structural and other properties to allow them to be used in the practice of this invention in place of rigidly set foam and still achieve the objects of this invention as set forth below.

Because special tools are needed for constructing traditional wood frames or, alternatively, their purchase from a framing store is expensive, newer types of frames made from extruded metal or plastic side members and molded or cast metal or plastic corner pieces have become popular. A very wide variety of frame types and components exist. But, if frames are not available in the size that is required, the side members must be cut to make a frame of the size needed. Whether the side members are made of metal, plastic or wood, special tools such as saws, clamps, drills and screwdrivers are needed to construct and assemble these frames.

The problems associated with constructing and assembling existing frames as related above can be avoided by use of the present invention which is to construct picture frames from rigid foam side members and fitting corner pieces which, by means of its design, can be constructed to fit any particular size and can be assembled easily and without the use of special tools.

Other advantages and attributes of this invention will be seen from a reading of this specification.

SUMMARY OF THE INVENTION

An object of this invention is to provide an easily assembled, light weight picture frame.

A further object of this invention is to provide a picture frame that is easily assembled without the use of tools ordinarily required to assemble conventional picture frames.

A further object of this invention is to provide a picture frame that can be easily cut to size and assembled using only a typical table knife or equivalent.

A further object of this invention is to provide a picture frame having rigid foam side members.

A further object of this invention is to provide a picture frame having rigid foam side members which can be secured by barb clips.

A further object of this invention is to provide a barb clip for use in securing rigid foam side members into formed corner pieces.

A further object of this invention is to provide a molded barb clip for securing the picture, poster or displayed document in a rigid foam picture frame.

These objects, and other objects expressed or implied in this document, are accomplished by picture frames assembled from rigid foam such as two pound expanded polystyrene or similar material in cross-sectional shapes to fit into hard molded plastic connecting pieces which enclose the ends of the rigid foam side members. During assembly the side members are then inserted into the connecting pieces to form a polygon frame and are secured in place by barb clips which mate with sockets defined by the connecting pieces. No special tools are necessary, other than perhaps a table knife or equivalent. If the frame needs to be a particular size, the side members can be cut to the proper length simply by using a typical table knife. Because the connecting pieces are made to receive the cross-sectional shape of the side members the frame cannot be misassembled. A picture and backing can be installed in the usual manner and can be secured by simply poking barb clips into the side members. The clips preferably have a projecting flange that clamps the margins of the picture and backing against shoulders defined by the side members. The sides of the frame can be made more rigid by using tensioning line, such as braided wire, threaded through eyelets, i.e. loops, defined by the barb clips, on three or more sides and then tying the line's ends together to form a taut loop. After assembly, the frame can be painted or otherwise colored as desired.

DESCRIPTION OF THE PREFERRED EMBODIMENT

Figure 1:
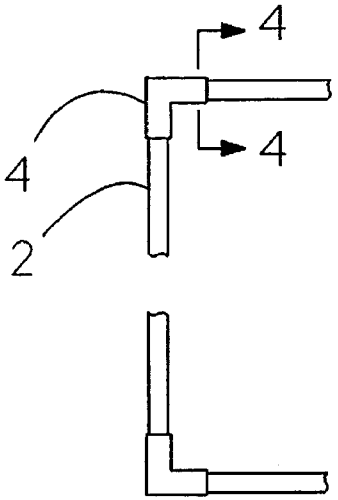
FIG. 1 is a broken front view of a right angled corner piece embodiment of a picture frame, according to this invention, as it would appear mounted on a wall.
Figure 2:
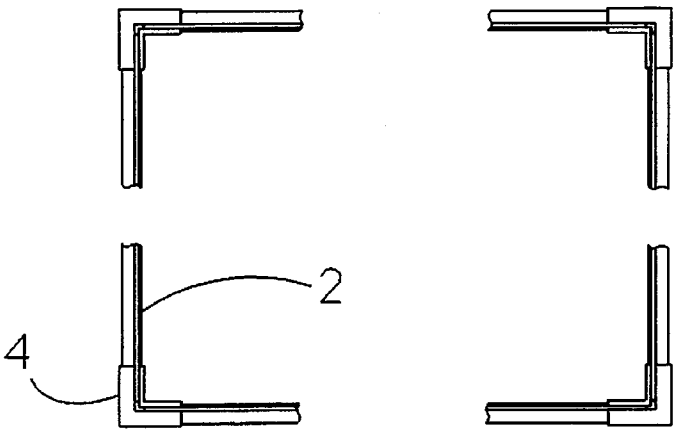
FIG. 2 is a broken view of the rear of the picture frame revealing a ledge around the inside periphery of the frame on which the picture or poster is secured.
Figure 3:
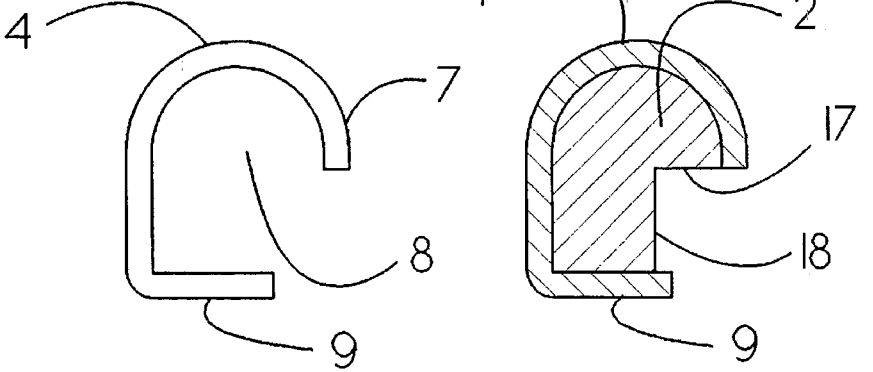
FIG. 3 is an end view of one leg of an angled corner piece as shown in FIG. 1.

FIGS. 1–5 illustrate components included in the preferred embodiment of the invention which is a rectangular picture frame consisting of four right angle corner pieces 4 and four side members 2. Preferably the corner pieces are made from hard molded, structurally rigid plastic. The picture frame of the invention can also be made using various acute and obtuse angled corner pieces to make picture frames of other shapes, such as: triangles, pentagons, hexagons and octagons, all utilizing rigid foam side members 2 and corner pieces having the appropriate angle. The corner pieces 4 have two perpendicular legs 6, each having a hollow interior 8 and a transverse cross-sectional shape of an inverted "j" having a curved lip 7 and a flat lip 9. The side members 2 are made of rigid foam as defined and are constructed to have the same transverse cross-sectional profile as the hollow interior 8 of the legs of the corner pieces. The side members have a flat surface 16 and a border surface 18 that meet at a right angle. The flat surface 16 together with the margin of the curved lip of the corner piece form a shoulder 17 that the poster or picture abuts when installed.

Figure 4:
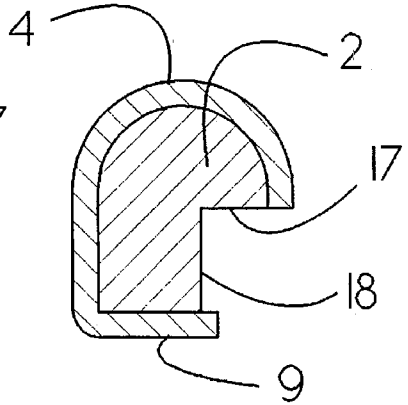
FIG. 4 is a cross sectional view of the picture frame taken along line 4—4 of FIG. 1.
Figure 5:
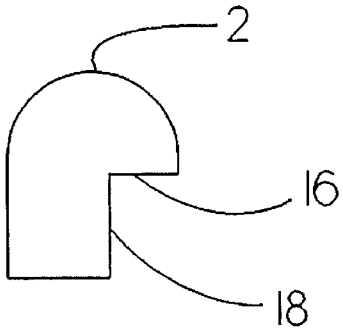
FIG. 5 is an end view of a rigid foam side member insertible into the corner piece leg shown in FIG. 3 to form the assemblage illustrated in FIG. 4.

Referring to FIGS. 4 and 6–8, the corner pieces define "hang" notches 10 in each of the legs. These can be single or multiple notches and are for use in hanging the frame, when assembled, onto hooks or nails in a wall. With hang notches in both legs the frame can easily be hung either horizontally in a typical landscape style or vertically in a typical portrait style. The preferred embodiment of the corner piece has three notches to allow considerable tolerance and thus eliminating the need for putting nails in the wall at a precise distance from each other. These notches account in part for an extension of the flat lips 9 of the corner pieces beyond the border surfaces 18 of the side members, as best shown in FIG. 4. This extension of the flat lips allows the notches to have sufficient depth to hang the frame on hooks or nails without obstruction from, or deformation of, the side members.

Referring to FIGS. 6–8 and 10, the legs of the corner pieces also define rectangular sockets 12 inside (with respect to the junction of the legs) the hang notches 10. The second embodiment of the corner pieces (FIG. 8) also has rectangular sockets 14 outside the hang notches. These rectangular sockets, 12 and 14, accommodate the insertion of barb clips 20 into the side members to secure the side members in the corner pieces. Each barb clip has a head 58 and the heads of barb clips inserted into side members mate with, i.e. fit into, the rectangular sockets and thus lock the side members into the corner pieces. The heads of the barb clips as illustrated have a rectangular shaped face. The rectangular shape of the sockets conform to the rectangular shape of the mating heads of each barb clip. It should be understood that the notches, 12 and 14, could be any shape that conforms to the shape of a mating head of the barb clips.

Figure 11:
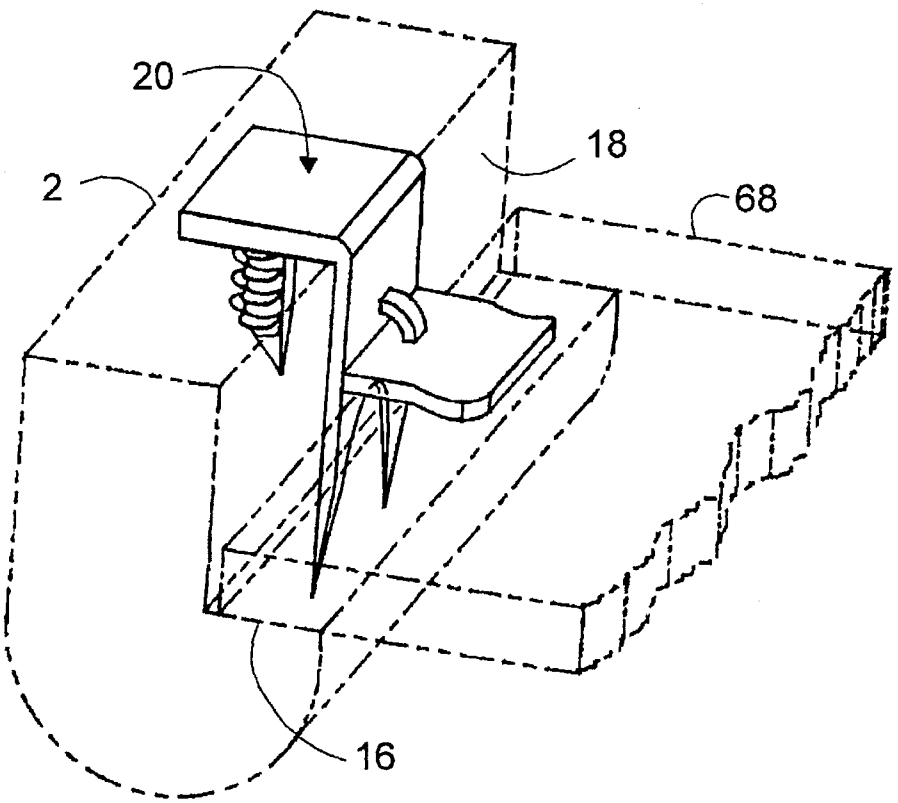
FIG. 11 is a perspective view showing how the barb clip of FIG. 9 is positioned when it is inserted into a rigid foam side member and how it holds a poster or picture and backing in place.
Figure 9:
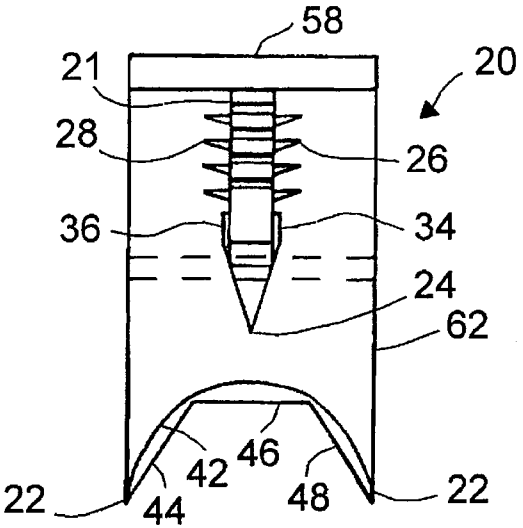
FIG. 9 is a front elevational view of a barb clip according to this invention.
Figure 10:
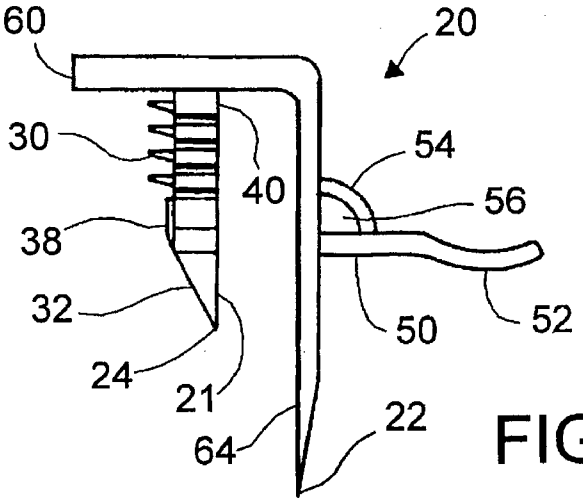
FIG. 10 is a side elevational view of the barb clip of FIG. 9.

Referring to FIGS. 9–11, the barb clip 20, as illustrated is molded in a single piece from plastic, Teflon or similar material. Each barb clip has an inverted "L" shaped body comprising the above-discussed rectangular head 58 at a top leg (as illustrated) with essentially the same thickness 60 as the frame corner pieces and the size and shape conforming to the rectangular sockets, 12 and 14, (FIGS. 7 and 8) of the corner pieces. A vertical (as illustrated) planar shank 62 is the second leg of the "L" and the two legs are planar pieces that are formed together at essentially right angles to each other. The thickness of the shank 62 in the preferred embodiment would be less than the top since it need not conform to the thickness of the corner piece and so as to present as little interference between the border surface 18 of a side member 2 and the poster or picture 68 as possible. The width of the shank could be greater or less than the head but in the preferred embodiment it is the same as the width of the head. The free end of the shank defines two points 22 and between the two points are inside edges 44 and 48 separated by a horizontal edge 46. The lengths of edges 44, 46, and 48 can vary as can the angle of the points 22, however, in the preferred embodiment the lengths of edges 44, 46, and 48 are essentially equal. The edges at 44, 46 and 48 are sharpened by molding a chamfer into the width of the shank from an essentially semi-circular arc 42 to the edges 44, 46, and 48. The points are further sharpened for piercing into the rigid foam side members by molding a chamfer in the thickness of the points of the shank with the points 22 aligned on the plane of the inside surface 64 of the shank.

Referring again to FIGS. 9–11, the head 58 has a barbed spike 21 projecting perpendicularly from its underside at or about its center and aligned with the longitudinal axis (not shown) of the shank 62. The barbed spike has a central column 40 having a semi-circular transverse cross-section and terminating in a point 24 which is aligned with the column's inside surface, nearest the shank 62. The point 24 is on or about an imaginary plane defined by the points 22 and the free end of the head. Along the central column 40, extending from proximate the head 58 to about half the length of the central column are a plurality of laterally projecting barbs or tines, some 30 from the front surface of the column and some, 26 and 28, from the side surfaces of the column. There are no barbs or tines on the rear or inside surface of the central column nearest the shank. The tines are all spaced equidistant from each other on each surface. The side tines, 26 and 28, project opposite to each other. However, the tines 30 on the front surface of the central column are offset vertically from the levels of the side tines, 26 and 28, by one-half the distance between the tines. The tines project outward approximately one-half the width of the central column. The tines are as wide as the central column and their corners are slightly rounded. Tines with widths different from the central column and tines having squared corners would also be effective. The surface of the tines facing the head 58 are parallel to the head, while the surfaces facing away from the head are angled to intersect the top surface of the tine and form a thin edge at the outward extremities of the tines. Below the level of the tines, the central column's front and side surfaces widen and project outward at 34, 36 and 38 to approximately one-half the distance that the tines project from the central column. The lower portion of these widened projections terminate in the cone shape 32 and into the point 24.

Referring again to FIGS. 9–11, projecting perpendicularly from the outside of the shank 62, at or about its mid-point, is a flange 50 which is preferably an integral part of the shank. The flange extends generally in a plane parallel with the head 58 and is or about the same length as the head. Preferably the flange is the same width as the shank but could be either wider or narrower than the shank and still be effective. The outer half of the flange has a slightly curved shape with the radius of the curve to the top of the flange so that the convex side 52 of the curve faces downward. This curved portion of the flange provides a pressure surface for pressing against the poster or picture 68.

Figures 12, 13:
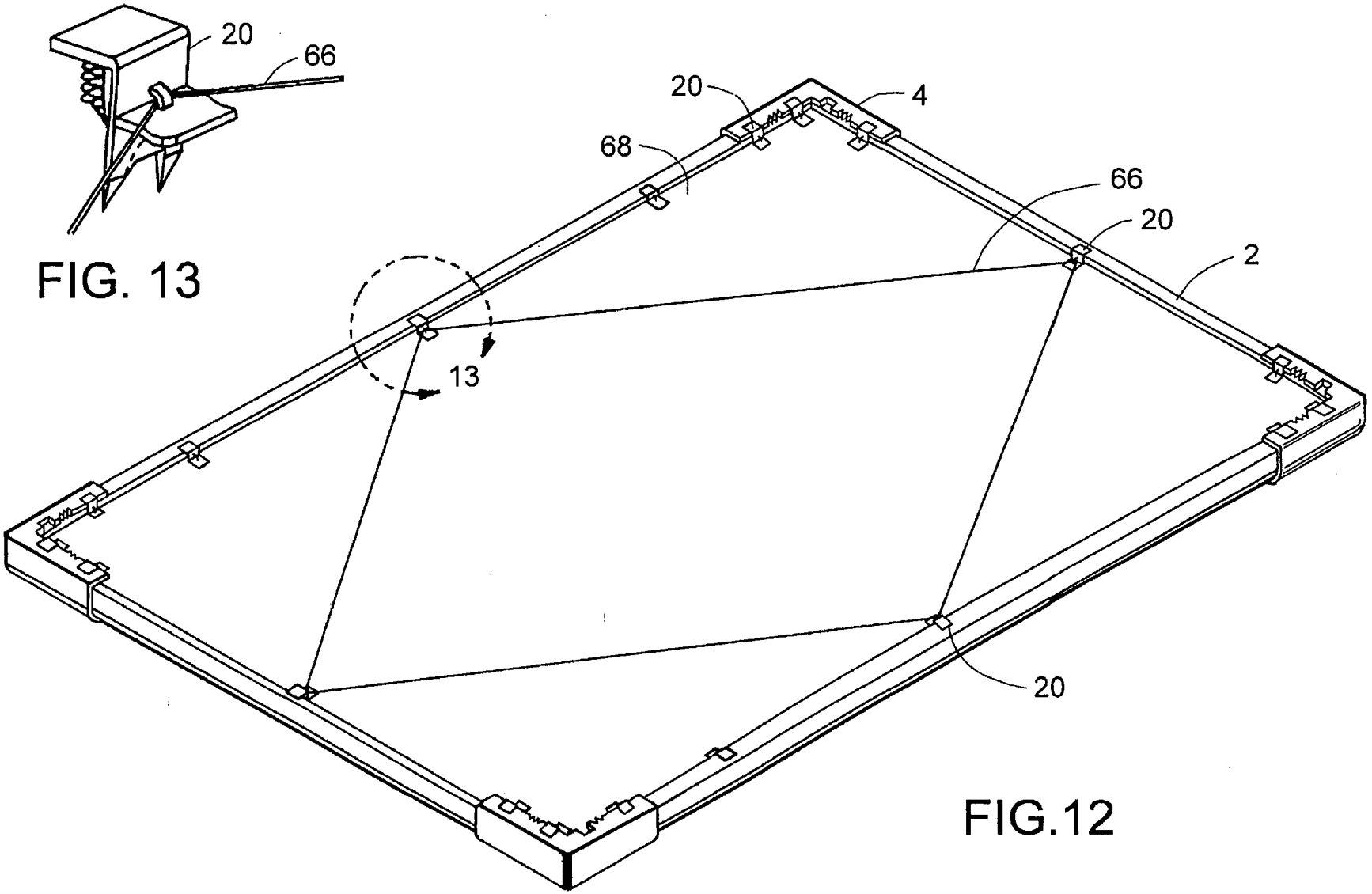
FIG. 12 is a perspective view of the rear of the assembled picture frame showing barb clips securing rigid foam side members in the corner pieces and also showing wire extending through loops in the barb clips to provide additional stability and rigidity to the picture frame.
FIG. 13 is a detailed perspective view of the barb clip shown in FIG. 12 within the circular arrows numbered 13.

Referring to FIGS. 10 and 11–13, a loop 54 extends from the shank 62 to the top side of the flange 50. Preferably the loop is integral with the shank and the flange and has a width approximately equal to the central column 40 of the barb spike 21. The opening 56 defined by the loop is large enough to allow a line 66, such as wire, rope, cord, string or other material, to be easily passed through it. The loop acts as an anchor point or support for the line 66 for use in adding stability to the picture frame, as best shown in FIGS. 12 and 13.

Referring again to FIGS. 9–11, the cone shape 32 at the end of the barbed spike 21 allows it to easily penetrate the side members when downward pressure is applied to the head 58. The widened projections 34, 36 and 38 help to shield the tines 21, 28 and 30 as the barbed spike is plunged completely into the side member where the tines act to anchor the spike in the side member. The shape of the tines resists any removal force. The absence of any tines on the inside surface of the central column 40 facing the shank 64 allows the rigid foam material of the side member between the central column and the shank to remain undisturbed and to provide sufficient strength to resist a pulling force on the loop 54 on the backside of the shank 62. The points 22 at the end of the shank assist in anchoring the barb clip into place. As the barb clip is inserted into the side member the inside surface of the shank 64 is pressed against the border surface 18 of the side member which keeps the barbed spike 21 in proper position for insertion into the side member. As the barb clip is pressed into the foam the points 22 on the shank pierce the flat side 16 of the side member. These points provide additional resistance to any pulling force at the loop 54 by the line 66 or other tension producing material, as best shown in FIGS. 12 and 13.

Figure 6:
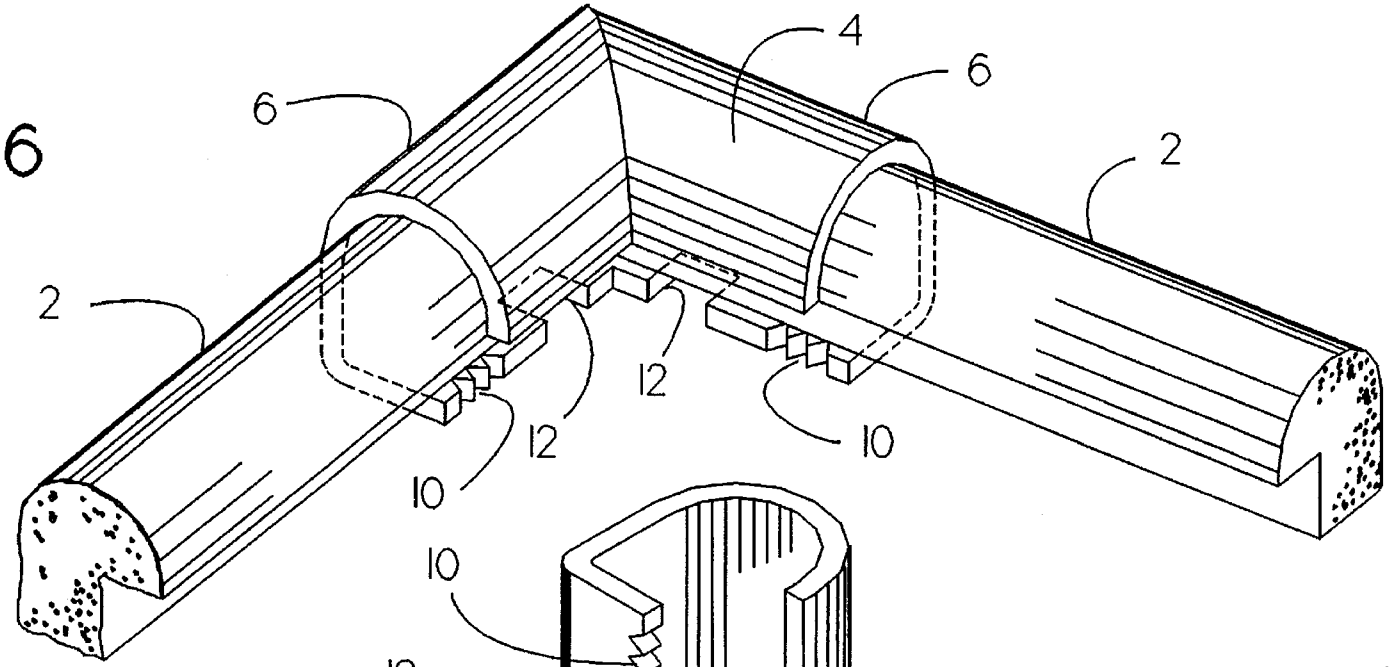
FIG. 6 is a perspective view of a corner piece with two sectional pieces of rigid foam side members installed in respective legs of the corner piece.
Figure 7:
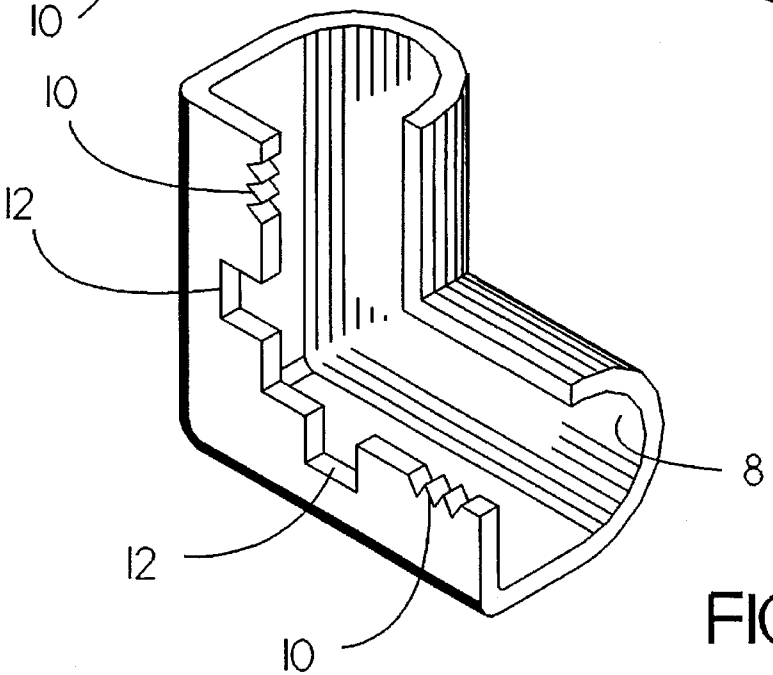
FIG. 7 is a perspective view of a corner piece showing the details of same from the rear.
Figure 8:
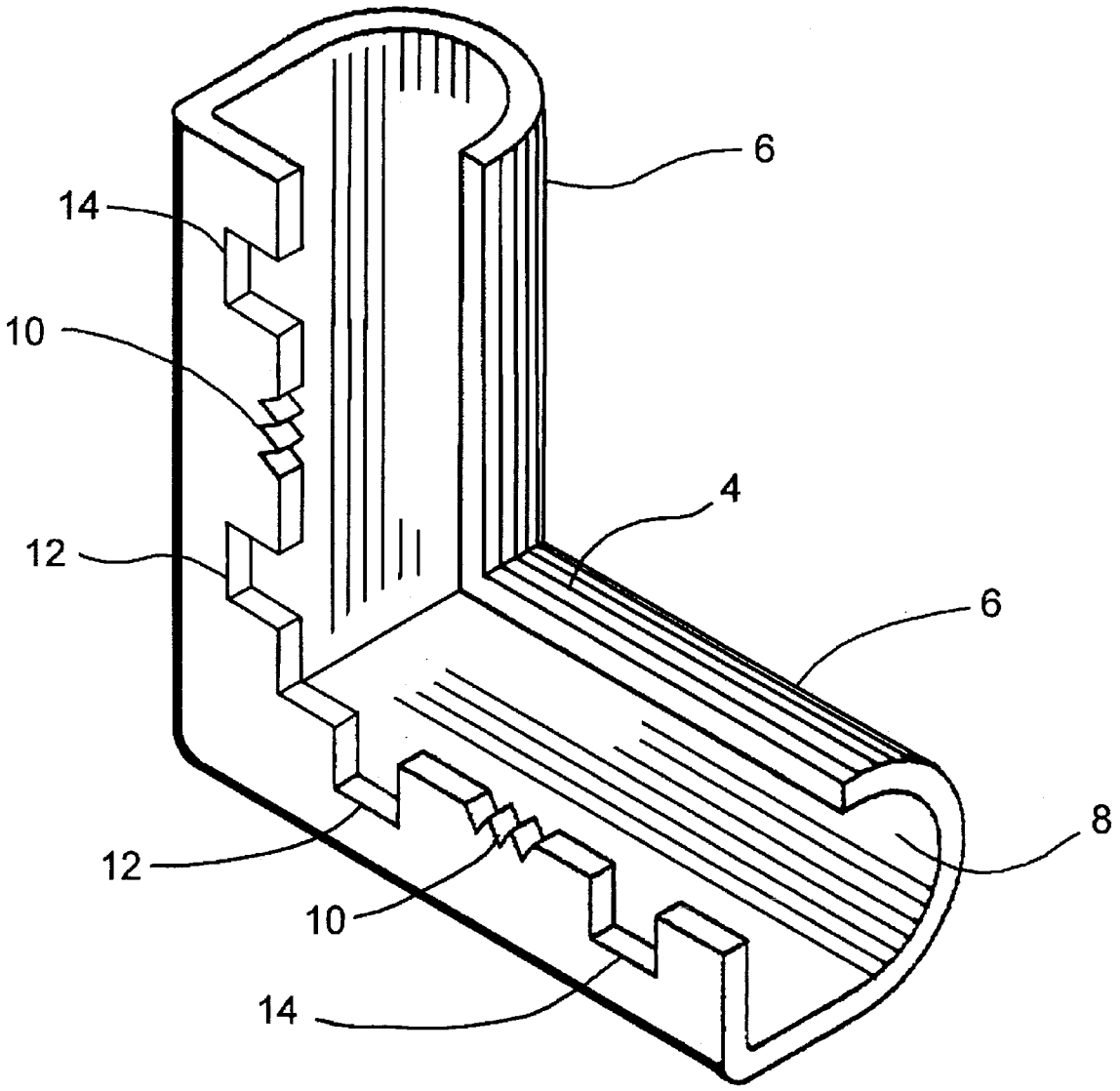
FIG. 8 is a perspective view from the rear of a second embodiment of a corner piece.

No tools, other than perhaps a table knife or equivalent, are necessary to assemble the picture frame. FIG. 6 illustrates how the corner pieces 4 connect the rigid foam side members 2 to form a corner of a picture frame. The side members are inserted into the legs 6 of the corner pieces which enclose and hold the side members in position. As shown in FIG. 12, with the side members assembled into the corner pieces, the poster, picture, or displayed item 68 is placed into the frame from the rear, allowing the front surface of the poster or other displayed item to rest against the flat side 16 of the side members as shown in FIG. 11. Barb clips 20 are next inserted into the side members at least one of the rectangular sockets, 12 or 14, of each leg of the corner pieces to secure the side members in the corner pieces. The barb clips are inserted with the inside surface 64 of the shank 62 of the barb clips against the border surface 18 of the side member. The points 22 of the barb clip will pass between the border surface and the edge of the poster 68 as the barb clip is pressed down into the side member. The points are shaped so that the tip of the points is in line with the inside surface of the shank. This slope of the points will help allow the points to pass between the poster and the border surface with minimum interference. Keeping the inside surface of the shank against the border surface as the barb clip is pressed in will properly position the barbed spike 21 to pierce into the side member. As the barb clip is pressed into position, the curved portion of the flange 52 will hold the poster, picture or other displayed item in position.

If a barb clip has to be removed, it will also remove the rigid foam material immediately around the barbed spike 21 that has become embedded in the tines 26, 28 and 30. This will prevent the clip from effectively being placed back into the same position since there will be insufficient rigid foam material to anchor the barbed spike 21. However, since each corner piece of the second embodiment has at least two rectangular sockets, 12 or 14, in each leg of the corner pieces, the barb clip can simply be reinserted into the position of the other rectangular socket. For example, if the outside rectangular sockets 14 were used first, then the inside rectangular sockets 12 could be used next.

Referring to FIGS. 10, 12 and 13, once the side members are secured into the corner pieces by barb clips which are also holding the poster, picture or other displayed item in place, additional barb clips can be pressed into the side members at or about there mid-points, as best shown in FIG. 12. A line 66 can be used to add stability to the frame by simply threading the line through the openings 56 in the loops 54 then tying the ends of the line together in a closed taut loop.

The rigid foam material of which the side members consist can easily be cut with a table knife. This feature allows picture frames to easily be assembled for the particular size needed, rather than having to use a standard size frame that is too large. Opposite side members can be cut to the same length by aligning their ends and cutting them at the same time to the desired length by making a cut completely through the rigid foam side members and perpendicular to their longitudinal axes. Additionally, assembled picture frames can be adjusted in size slightly, without having to cut the side members, by repositioning the ends of the side members in the corner pieces. This method can be used to obtain a more accurate fit of the picture frame to the displayed object. Assembled picture frames can easily be cut to a new smaller size or new larger side members can be used to easily make a larger picture frame. If a picture frame is desired in a different color, it can easily be painted. Or, alternatively, different textured or patterned materials can be used to cover the side members and can be easily held in place simply by pinning them on the rear side.

This embodiment has described the invention using side members having a rigid foam composition. Other materials having similar characteristics of rigidity and strength needed to be able to function as a picture frame and also having similar cleavability, the ability to be cut with a knife but without special tools, are also encompassed by this invention.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example the corner pieces described above need not necessarily connect only two side members, but rather can be designed to connect more than two. For example, the corner pieces can be in the form of a "T" section for connecting three side members, or in the form a multi-leg star connecting as many side members as the star has legs.

I claim:

1. A display frame comprising:

(a) a plurality of elongated, foam side members;

(b) a plurality of connecting means for connecting the side members into a closed frame;

(c) each connecting means comprising a plurality of conjoined legs, each leg defining a hollow, open end for receiving therein an end of a side member;

(d) means for affixing a side member received by a leg to the leg, said means comprising:

(1) spike means for penetrating the side member, and (2) socket means, defined by the leg, for engaging the spike means; and (e) means for affixing display material to a side member.

2. The display frame according to claim 1 further comprising barb means, connected to the spike means, for inhibiting removal of the spike means from the side member.

3. The display frame according to claim 1 further comprising:

(a) tension line means for structurally supporting the frame, and (b) loop means, affixed to each side member, for providing anchor points for the tension line means.

4. The display frame according to claim 1 wherein the spike means includes a head and the socket means comprises an opening into which the head fits.

5. The display frame according to claim 4 further comprising barb means, connected to the spike means, for inhibiting removal of the spike means from the side member.

6. A display frame comprising:

(a) a plurality of elongated, foam side members;

(b) a plurality of connecting means for connecting the side members into a closed frame;

(c) each connecting means comprising a plurality of conjoined legs, each leg defining a hollow, open end for receiving therein an end of a side member;

(d) means for affixing a side member received by a leg to the leg; and (e) means for affixing display material comprising:

(1) shoulder means, defined by a side member, for abutting a margin of the display material, (2) flange means for clamping the margin against the shoulder means, and (3) means for affixing the flange means to the side member.

7. The display frame according to claim 6 further comprising:

(a) tension line means for structurally supporting the frame, and (b) loop means, affixed to each side member, for providing anchor points for the tension line means.

8. The display frame according to claim 6 wherein the means for affixing the flange means comprises shank means, connected to the flange means, for penetrating the shoulder means.

9. The display frame according to claim 8 further comprising:

(a) tension line means for structurally supporting the frame, and (b) loop means, affixed to each shank means, for providing anchor points for the tension line means.

10. The display frame according to claim 6 wherein the means for affixing a side member received by a leg to the leg comprises:

(a) spike means for penetrating the side member, and (b) socket means, defined by the leg, for engaging the spike means.

11. The display frame according to claim 10 further comprising:

(a) tension line means for structurally supporting the frame, and (b) loop means, affixed to each side member, for providing anchor points for the tension line means.

12. The display frame according to claim 10 further comprising barb means, connected to the spike means, for inhibiting removal of the spike means from the side member.

13. The display frame according to claim 10 wherein the spike means includes a head and the socket means comprises an opening into which the head fits.

14. The display frame according to claim 10 wherein the means for affixing the flange means comprises shank means, connected to the flange means, for penetrating the shoulder means.

15. The display frame according to claim 14 further comprising:

(a) tension line means for structurally supporting the frame, and (b) loop means, affixed to each shank means, for providing anchor points for the tension line means.

16. The display frame according to claim 14 wherein the spike means includes a head and the socket means comprises an opening into which the head fits.

17. The display frame according to claim 16 wherein the head of the spike means and the shank means are integral parts of an "L" shaped member, one leg of the "L" being the head of the spike means and the other leg of the "L" being the shank means.

* * * * *